US005593557A

United States Patent [19]

Sopher et al.

[11] Patent Number: 5,593,557

[45] Date of Patent: Jan. 14, 1997

[54] ELECTRODE CONSISTING OF AN IRON-CONTAINING CORE AND A LEAD-CONTAINING COATING

[75] Inventors: David Sopher, Stockton-on-Tees, Great Britain; Andreas Gieseler, Bad Durkheim, Germany; Hartmut Hibst, Schriesheim, Germany; Klaus Harth, Altleiningen, Germany; Peter Jaeger, Battenberg, Germany

[73] Assignee: BASF Aktiengesellschaft, Ludwigshafen, Germany

[21] Appl. No.: 518,600

[22] Filed: Aug. 14, 1995

Related U.S. Application Data

[63] Continuation of Ser. No. 255,746, Jun. 7, 1994, abandoned.

[30] Foreign Application Priority Data

Jun. 16, 1993 [DE] Germany ..... 43 19 951.8

[51] Int. Cl.[6] ..... C25B 11/00

[52] U.S. Cl. ..... 204/290 R

[58] Field of Search ..... 204/290 R

[56] References Cited

U.S. PATENT DOCUMENTS

| | | | |
|---|---|---|---|
| 3,193,481 | 7/1965 | Balzer | 204/73 |
| 3,193,482 | 7/1965 | Balzer | 204/73 |
| 3,193,483 | 7/1965 | Balzer | 204/73 |
| 3,844,911 | 10/1974 | Ruehlen | 204/73 |
| 3,898,140 | 8/1975 | Lester, Jr. | 204/73 A |
| 4,038,170 | 7/1977 | Rhees et al. | 204/290 R |
| 4,306,949 | 12/1981 | Campbell et al. | 204/73 |
| 4,867,858 | 9/1989 | Matsuzawa et al. | 204/290 R |

FOREIGN PATENT DOCUMENTS

| | | | |
|---|---|---|---|
| 090435 | 10/1983 | European Pat. Off. . | |
| 0132029 | 1/1985 | European Pat. Off. | 204/290 R |
| 270390 | 6/1988 | European Pat. Off. . | |

OTHER PUBLICATIONS

Danly, *J. Elec. Chem. Soc.*, Oct. 1984, vol. 131, pp. 435c–442c.

Beck, *J. of App. Electrochem.*, vol. 2, pp. 59–69, 1972. No Month Available.

Derwent Abstract 84–123614/20, English abstract of JP 84/59888. 1984 No Month Available.

*Chem. Abst.*, vol. 83, Abst. No. 14825, Jul. 14, 1975 (English abstract of JP–A 49 047 610).

*Primary Examiner*—Bruce F. Bell

*Attorney, Agent, or Firm*—Keil & Weinkauf

[57] ABSTRACT

An electrode consisting of an electrically conductive core essentially comprising iron and an electrically conductive coating essentially comprising lead, a process for the production of the novel electrode, its use for the reductive coupling of olefinic reactants and an improved process for the reductive coupling of olefinic reactants.

8 Claims, No Drawings

ELECTRODE CONSISTING OF AN IRON-CONTAINING CORE AND A LEAD-CONTAINING COATING

This application is a continuation of application Ser. No. 08/255,746, filed on Jun. 7, 1994 now abandoned.

BACKGROUND OF THE INVENTION

1. Field of the Invention

The present invention relates to an improved electrode consisting of an electrically conductive core essentially comprising iron and an electrically conductive coating essentially comprising lead.

The present invention furthermore relates to a process for the production of the novel electrode, its use for the reductive coupling of olefinic reactants and an improved process for the reductive coupling of olefinic reactants.

2. Description of the Prior Art

The use of lead cathodes in electrochemical processes, for example in the electrohydrodimerization of acrylonitrile to adipodinitrile (ADN), is known. For example, US-A 3,193,481, US-A-3,193,482 and US-A 3,193,483 describe the electrochemical preparation of ADN in a divided cell, pure lead being used as the cathode. In Organic Electrochemistry, Edit. Baizer and Lund, Marcel Dekker, New York, 1984, 986, a lead cathode containing 7% by weight of antimony is used for a similar preparation of ADN.

DE-A 2,338,341 describes the use of pure lead cathodes in undivided electrochemical cells for the preparation of ADN.

SUMMARY OF THE INVENTION

The disadvantage of the abovementioned electrodes is that, regardless of whether the cathodes are composed of lead or of another material, for example cadmium, the anodes and cathodes undergo corrosion during the reaction and produce troublesome degradation products, which may lead, inter alia, to deposits on the electrodes. In particular, in the electrohydrodimerization of acrylonitrile, these deposits may lead to a decrease in the selectivity with regard to adipodinitrile and to increased hydrogen formation. It is therefore important to prevent deposits caused by electrode degradation, inter alia on the cathode surface.

A possible method for preventing such deposits is described in US-A 3,898,140, in whose process ethylenediaminetetraacetate (EDTA) is used as a chelating agent. The use of triaalkylolamines with the same effect is described in GB-A 1,501,313.

A disadvantage of such chelating agents is, however, that the lead cathode is consumed too rapidly (JP-A 84/59888). In order to overcome this disadvantage, it has been proposed that the use of chelating agents be dispensed with by, instead, freeing the electrolyte continuously from electrode degradation products by passing it over a column containing a chelate-containing resin.

A further development in the preparation of ADN in an undivided electrochemical cell is described in EP-A 270 390. This document claims, as the cathode, a lead alloy containing 1% by weight or less of copper and tellurium. The disadvantage here is that the electro-hydrodimerization must be carried out in the presence of a certain amount of an ethyltributylammonium salt. Even under these conditions, the corrosion rate is still too high.

It is an object of the present invention to provide an electrode having higher corrosion resistance than a cathode consisting of lead or lead alloys. In particular, the preparation of adipodinitrile by electro-hydrodimerization of acrylonitrile should be made more economical and more environment-friendly as a result.

We have found that this object is achieved by an electrode consisting of an electrically conductive core essentially comprising iron and an electrically conductive coating essentially comprising lead.

We have furthermore found a process for the production of this electrode, the use of the novel electrode for the reductive coupling of olefinic reactants and an improved process for the reductive coupling of olefinic reactants.

The novel electrode consists of an electrically conductive core essentially comprising iron and an electrically conductive coating essentially comprising lead.

Observations to date have shown that the choice of the iron used is not critical. However, there are a number of processes for which it may be advantageous to use particularly corrosion-resistant ferrous steels.

The design of the electrodes is likewise not critical, so that the skilled worker may choose suitable electrode types from the large number of conventional electrode types, such as plane-parallel plates, tubes, nets and disks. Plane-parallel plates are preferably chosen.

DESCRIPTION OF THE PREFERRED EMBODIMENTS

The electrically conductive coating consists, according to the invention, essentially of lead. In addition to lead, the coating may also contain further elements, such as copper, silver, selenium, tellurium, bismuth and antimony, in amounts of up to 3.5, preferably from 0.5 to 2, particularly preferably from 0.8 to 1.5, % by weight. Observations to date have shown that a coating having the following composition is preferred: from 96.5 to 99.5, preferably from 98 to 99.5, % by weight of lead, from 0.3 to 3, preferably from 0.5 to 2, % by weight of copper and from 0 to 3, preferably from 0 to 2, % by weight of silver and/or bismuth and/or selenium and/or tellurium and/or antimony.

The electrically conductive coating can be applied by a conventional method. Application by electroplating, ie. electrolytically, and by physical deposition methods selected from the group consisting of vapor deposition, sputtering (ie. deposition of metal vapor) and arc coating is particularly preferred.

The process of electroplating is sufficiently well known, for example from Modern Electroplating (Editor: Lowenheim, J. Wiley, New York, 1974), so that further statements in this context are superfluous. Furthermore, observations to date have shown that the type of electroplating baths is of minor importance.

An electroplating bath having an iron or steel sheet as the cathode and a lead strip as the anode is preferably used, the two electrodes advantageously being arranged parallel to one another (cf. Modern Electroplating).

The electrolyte solution usually contains the lead to be deposited and, if desired, further elements in the form of their water-soluble salts.

An aqueous fluorosilicic acid, an aqueous fluoroborate solution or a $C_1$–$C_4$-alkanesulfonic acid solution, such as methane-, ethane-, propane- or butanesulfonic acid solution, is preferably used as the electrolyte solution, methanesulfonic acid solution being preferred.

In a fluoroborate bath, the electrolyte solution generally consists essentially of lead fluoroborate. Advantageously, the electrolyte solution also contains conventional assistants, such as fluoroboric acid, boric acid and conventional organic additives, such as a peptone, resorcinol or hydroquinone, for achieving fine-particled smooth deposits.

The concentrations stated below relate to 1 l of electrolyte solution, unless stated otherwise.

Lead fluoroborate is usually used in concentrations of from 5 to 500, preferably from 20 to 400, g/l. Fluoroboric acid is generally used in the range from 10 to 150, preferably from 15 to 90, g/l. Boric acid is used, as a rule, in the range from 5 to 50, preferably from 10 to 30, g/l. Conventional organic additives are used in general in amounts of from 0.1 to 5 g/l.

The further elements possible in addition to the lead, such as copper, silver, selenium, tellurium, bismuth and/or antimony, are advantageously used in the form of their fluoroborate salts, oxides, hydroxides or carbonates, in concentrations of from 0.1 to 10, preferably from 0.5 to 10, g/l.

In the case of a $C_1$–$C_4$-alkanesulfonic acid bath, in particular a methanesulfonic acid bath, lead is usually used in the form of its salt of methanesulfonic acid, in amounts of from 10 to 200, preferably from 10 to 60, g/l. Similarly to the fluoroborate bath, the electrolyte solution also contains conventional assistants, such as the corresponding $C_1$–$C_4$-alkanesulfonic acid, as a rule methanesulfonic acid, in an amount of from 20 to 150, preferably from 30 to 80, g/l, and surfactants, for example one based on alkylphenol ethoxylates, such as Lutensol® AP 10 (BASF AG), in amounts of from 1 to 20, preferably from 5 to 15, g/l. Lutensol® AP 10 is an isononylphenol ethoxylated with 10 moles of SOPHER et al., Ser. No. 08/255,746 ethylene oxide to one mole of isononylphenol. In addition to the lead, the electrode coating may contain the elements stated further above, such as copper, silver, selenium, tellurium, bismuth and/or antimony, which are advantageously added to the electrolyte solution in the form of their corresponding $C_1$–$C_4$-alkanesulfonic acid salts, oxides, hydroxides or carbonates, in amounts of from 0.1 to 20, preferably from 0.5 to 10, g/l.

In the case of electroplating, a DC voltage of from 0.5 to 20, preferably from 1 to 10, volt is generally applied to the electrodes. The current density during electroplating is, as a rule, from 1 to 200, preferably from 5 to 40, mA/cm$^2$.

The duration of electroplating depends on the chosen reaction parameters and on the desired layer thickness of the coating and is usually from 0.5 to 10 hours. In general, the layer thickness is chosen to be from 1 to 500 μm, preferably from 20 to 200 μm.

The temperature during electroplating is preferably chosen to be from 10° to 70° C., the reaction preferably being carried out at room temperature.

The chosen pressure range is in general not critical, but atmospheric pressure is preferably employed.

The pH depends essentially on the electrolytes and additives used and is, as a rule, from 0 to 2.

Instead of a DC voltage, pulsed current techniques may also be used (cf. J.-C. Puippe, Pulse-Plating, E. Lenze Verlag, Saulgau, 1990).

A further preferred embodiment comprises electrochemical deposition in a cell divided by an ion exchange membrane, such as a cation or anion exchange membrane, preferably an anion exchange membrane. This procedure has the advantage that undesirable deposits of further elements used, in particular of copper, on the anode can be suppressed.

In principle, any form of electroplating cell suitable for this purpose, in particular the electroplating cells stated further above, may be used as the electroplating cell. The process parameters are in general identical to the abovementioned ones.

The anion exchange membrane used may be a commercial anion exchange membrane, such as Selemion® AMV (Asahi Glass), Neosepta® ACH 45T AM1, AM2 or AM3 (Tokoyama Soda) or Aciplex® A 101 or 102 (Asahi Chemical).

In a further preferred-embodiment, production of the novel electrode can also be carried out by physical deposition methods, such as vapor deposition, sputtering or arc coating.

Sputtering makes it possible to achieve a layer thickness of the electrode coating of from 5 Angström to 100 μm. Furthermore, sputtering permits the simple and reproducible production of a multicomponent layer, and, on the basis of knowledge to date, there is no limit with regard to the number of elements applied.

Furthermore, the microstructure of the electrode coating can be influenced by means of sputtering, by varying the process gas pressure and/or by applying a negative bias voltage. For example, a process gas pressure of from $4\cdot10^{-3}$ to $8\cdot10^{-3}$ mbar leads to a very dense, finely crystalline layer having high corrosion stability.

The application of a negative bias voltage during coating generally results in intense ion bombardment of the substrate, which, as a rule, leads to a very dense layer and to thorough interlocking of the applied layer with the substrate.

Moreover, by means of sputtering it is possible to tailor the structure of the electrode coating in such a way that, if at least one further element is used in addition to lead, the electrode coating consists of a plurality of layers, and the thickness of the individual layers can be varied in the abovementioned range.

In the case of sputtering, the coating material is generally applied in solid form, as a target, to the cathode of a plasma system, then sputtered under reduced pressure, for example from $1\cdot10^{-4}$ to 1, preferably from $5\cdot10^{-4}$ to $5\cdot10^{-2}$, mbar, in a process gas atmosphere by applying a plasma and deposited on the substrate (anode) to be coated (cf. R. F. Bhunshah et al., Deposition Technologies for Films and Coatings, Noyes Publications, 1982). In general, at least one noble gas, such as helium, neon or argon, preferably argon, is chosen as the process gas.

The plasma consists, as a rule, of charged (ions and electrons) and neutral (including free radical) components of the process gas, which interact with one another through impact and radiation processes.

Various versions of sputtering, such as magnetron sputtering, DC and RF sputtering or bias sputtering, as well as combinations thereof, can be used for the production of the electrode coating. In magnetron sputtering, as a rule, the target to be sputtered is present in an external magnetic field which concentrates the plasma in the region of the target and hence increases the sputtering rate. In DC and RF sputtering, the sputtering plasma is generally excited by a DC voltage or by an AC voltage (RF), for example having a frequency of from 10 kHz to 100 MHz, preferably 13.6 MHz. In bias sputtering, the substrate to be coated is usually provided with a bias voltage, which is generally negative and leads to intense bombardment of the substrate with ions during coating.

For the production of electrode coatings which contain further elements in addition to lead, in general a multicomponent target containing lead and at least one further element is sputtered. Examples of suitable targets are homogeneous alloy targets which can be prepared in a known manner by fusion or powder metallurgical methods, and inhomogeneous mosaic targets which can be prepared, as a rule, by uniting smaller fragments of different chemical compositions or by placing or sticking small disk-like pieces of material on homogeneous targets. As an alternative to these methods, two or more targets having different compositions may also be sputtered simultaneously (simultaneous sputtering).

The desired layer thickness and chemical composition and the microstructure of the electrode coating can be influenced essentially by the process gas pressure, the sputtering power, the sputtering mode, the substrate temperature and the coating time.

The sputtering power here is the power expended to excite the plasma and is, as a rule, from 50 W to 10 kW.

The substrate temperature is chosen in general to be from room temperature to 350° C., preferably from 150° to 250° C.

The coating time depends essentially on the desired layer thickness. Typical coating rates in sputtering are usually from 0.1 to 100 nm/s.

A further preferred embodiment is the production of the electrode coating by vapor deposition (cf. L. Holland, Vacuum Deposition of Thin Films, Chapman and Hay Ltd., 1970). The coating material is advantageously introduced in a conventional manner into a suitable vapor deposition source, such as an electrically heated evaporation boat or an electron beam evaporator. The coating material is then vaporized under reduced pressure, usually from $10^{-7}$ to $10^{-3}$ mbar, the desired coating forming on the electrode introduced into the vacuum unit.

In the production of multicomponent films, the material to be vaporized can be vaporized either in a suitable composition from a common source or simultaneously from different sources.

Typical coating rates in vapor deposition are in general from 10 nm/s to 10 μm/s.

In a particularly preferred embodiment, the substrate to be coated can be bombarded with ions before or during the vapor deposition process by means of an RF plasma or of a conventional ion gun, in order to improve the microstructure and the adhesion of the films. Furthermore, the microstructure and the adhesion of the films may also be influenced by heating the substrate.

The novel electrodes can be used for the reductive coupling of olefin reactants. Here, the olefinic reactants are usually reacted by a conventional electro-hydrodimerization method by subjecting them to electrolysis in an electrolysis cell having an anode and a novel electrode as the cathode.

Preferably used olefinic reactants are compounds of the formula $R^1R^2C{=}CR^3X$, where $R^1$, $R^2$ and $R^3$ are identical or different and are each hydrogen or $C_1$–$C_4$-alkyl, such as methyl, ethyl, n-propyl, isopropyl, n-butyl, isobutyl, sec-butyl or tert-butyl, and X is -CN, $-CONR^1R^2$ or $-COOR^1$. Examples are olefinic nitriles, such as acrylonitrile, methacrylonitrile, crotononitrile, 2-methylenebutyronitrile, 2-pentenenitrile, 2-methylenevaleronitrile and 2-methylenehexanenitrile, olefinic carboxylates, such as acrylates or methyl- or ethyl-acrylates, olefinic carboxamides, such as acrylamide, methacrylamide, N,N-dimethylacrylamide and N,N-diethylacrylamide, particularly preferably acrylonitrile.

In a particularly preferred embodiment, adipodinitrile is prepared by electrohydrodimerization of acrylonitrile with the aid of the novel electrode. The following data therefore relate to this process.

Observations to date have shown that the type of electrolysis cell is not critical, so that the skilled worker can choose from the range of commercial electrolysis cells. A preferred embodiment of the electrolysis cell is the undivided cell, plate-stack cells or capillary gap cells being particularly preferred. Such cells are described in detail in, for example, J. Electrochem. Soc. 131 (1984), 435*c*, and J. Appl. Electrochem. 2 (1972), 59.

The anode used may be known anodes; in undivided cells, materials having a low oxygen overvoltage, for example carbon steel, steel, platinum, nickel, magnetite, lead, lead alloys or lead dioxide, are usually preferably used (cf. Hydrocarbon Processing (1981), 161).

The novel electrodes are used as cathodes, and observations to date have shown that a composition of the following type can preferably be used: from 96.5 to 100, preferably from 98 to 99.5, % by weight of lead, from 0.3 to 3, preferably from 0.5 to 2, % by weight of copper, from 0 to 3, preferably from 0 to 2, % by weight of silver and/or bismuth and/or selenium and/or tellurium and/or antimony.

Usually, the electrolyte solution contains a conductive salt, particularly in the preparation of adipodinitrile, since otherwise the main product formed is generally propionitrile and increased hydrogen formation is likely. In general, the conductive salt is used in an amount of from 1 to 100, preferably from 5 to 50, mmol/kg of aqueous electrolyte solution.

Examples of suitable conductive salts are quaternary ammonium compounds, such as tetrabutylammonium salts and ethyltributylammonium salts, quaternary phosphonium salts and bisquaternary ammonium and phosphonium salts, such as hexamethylenebis(dibutylethylammonium hydroxide) (cf. Hydrocarbon Processing (1981), 161; J. Electrochem. Soc. 131 (1984), 435*c*).

Furthermore, the electrolyte solution usually contains a buffer, such as hydrogen phosphate or bicarbonate, preferably in the form of their sodium salts, particularly preferably disodium hydrogen phosphate, in an amount of from 10 to 150, preferably from 30 to 100, g/kg of aqueous electrolyte solution.

The electrolyte solution also preferably contains an anode corrosion inhibitor, such as the borates known for this purpose (cf. Hydrocarbon Processing (1981), 161), preferably disodium diborate and orthoboric acid, in an amount of from 5 to 50, preferably from 10 to 30, g/kg of aqueous electrolyte solution.

The electrolyte solution furthermore preferably contains a complexing agent in order to prevent the precipitation of iron and lead ions. Examples are ethylenediaminetetraacetate (EDTA), triethanolamine (TEOA) and nitrilotriacetate, preferably EDTA in an amount of from 0 to 50, preferably from 2 to 10, g/kg of aqueous electrolyte solution, and/or TEOA in an amount of from 0 to 10, preferably from 0.5 to 3, g/kg of aqueous electrolyte solution.

Acrylonitrile is generally used in an amount of from 10 to 50, preferably from 20 to 30, % by weight, based on the organic phase.

The reaction temperature is chosen, as a rule, to be from 30° to 80° C., preferably from 50° to 60° C.

The pH depends essentially on the composition of the electrolyte solution and is in general from 6 to 10, preferably from 7.5 to 9.

Observations to date have shown that the reaction pressure is not critical. It is usually chosen in the range from atmospheric pressure to 10 bar.

The current density is chosen in general to be from 1 to 40, preferably from 5 to 30, A/dm$^2$.

The flow rate in the continuous procedure is, as a rule, from 0.5 to 2, preferably from 0.8 to 1.5, m/sec.

The advantage of the novel electrode is that, when it is used as a cathode in the electrohydro-dimerization of acrylonitrile to adipodinitrile, the corrosion of the cathodes is substantially less than with the use of electrodes consisting completely of lead or lead alloys, which leads to longer lives and a smaller amount of heavy metals.

EXAMPLES

The stated corrosion rates of the electrodes were determined by means of atomic absorption spectroscopy (determination of the concentration of iron ions (anode) and lead ions (cathode) liberated by corrosion) and by determining the weight loss of the electrodes after completion of the reaction.

The stated selectivities were determined with the aid of a gas chromatograph.

Example 1

Production of a Novel Lead Electrode by Electrochemical Deposition from a Fluoroborate Bath The cathode used was a circular steel disk (diameter 20 mm), which was degreased and pickled in a conventional manner prior to electroplating. The anode used was a lead strip having the same dimensions as the cathode. The electrodes were mounted parallel to one another in a tank. The reaction mixture in the bath was agitated by mechanical stirring, and the bath temperature was 25° C.

The coating bath (1 l) had the following composition:

| | |
|---|---|
| Free fluoroboric acid | 20 g/l |
| Boric acid | 30 g/l |
| Lead fluoroborate | 90 g/l |
| Peptone | 0.5 g/l |
| Water | to 1 l |

Electroplating was carried out for 2.5 hours using a current density of 10 mA/cm$^2$. The film thickness was 50 μm.

Example 2

Production of a Novel Lead Electrode by Electrochemical Deposition, Containing 1.8% by Weight of Copper The procedure was as in Example 1, except that the coating bath additionally contained 2.6 g/l of copper fluoroborate. The film thickness was 50 μm.

Example 3

Production of a Novel Lead Electrode by Electrochemical Deposition, Containing 0.8% by Weight of Copper The procedure was as in Example 1, except that the coating bath additionally contained 0.7 g/l of copper fluoroborate. The film thickness was 50 μm.

Example 4

Production of a Novel Lead Electrode by Electrochemical Deposition, Containing 1.3% by Weight of Copper The procedure was as in Example 1, except that the coating bath additionally contained 1.6 g/l of copper fluoroborate. The film thickness was 50 μm.

Example 5

Production of a Novel Lead Electrode by Electrochemical Deposition, Containing 3.7% by Weight of Copper The procedure was as in Example 1, except that the coating bath additionally contained 5.6 g/l of copper fluoroborate. The film thickness was 50 μm.

Example 6

Production of a Novel Lead Electrode by Electrochemical Deposition, Containing 2.2% by Weight of Copper and 1.3% by Weight of Bismuth The procedure was as in Example 1, except that the coating bath additionally contained 1.25 g/l of copper fluoroborate and 0.5 g/l of bismuth nitrate. The film thickness was 50 μm.

Example 7

Production of a Novel Lead Electrode by Electrochemical Deposition, Containing 1.3% by Weight of Copper and 0.5% by Weight of Tellurium The procedure was as in Example 1, except that the coating bath additionally contained 1.5 g/l of copper fluoroborate and 0.65 g/l of tellurium dioxide. The film thickness was 50 μm.

Example 8

Production of a Novel Lead Electrode by Electrochemical Deposition, Containing 1.3% by Weight of Copper and 0.1% by Weight of Selenium The procedure was as in Example 1, except that the coating bath additionally contained 2.7 g/l of copper fluoroborate and 0.15 g/l of selenium dioxide. The film thickness was 50 μm.

Example 9

Production of a Novel Lead Electrode by Electrochemical Deposition (a) The procedure was as in Example 1, except that steel sheets (3 cm×80 cm) were used as the cathode. The anode consisted of a lead strip having the same dimensions. The current density was 20 mA/cm$^2$ and the coating time was 2.5 hours. The film thickness was 100 μm.

(b) The procedure was as in Example 9(*a*), except that the coating bath (10 l) had the following composition:

| | |
|---|---|
| Free methanesulfonic acid | 32 g/l |
| Lead methanesulfonate | 70 g/l |
| Lutensol ® AP 10 | 10 g/l |

The film thickness was 100 μm.

(c) The procedure was as in Example 9(*b*), except that the coating bath (10 l) had the following composition:

| | |
|---|---|
| Free methanesulfonic acid | 32 g/l |
| Lead methanesulfonate | 70 g/l |
| Copper methanesulfonate | 5.2 g/l |
| Lutensol ® AP 10 | 10 g/l |

Electroplating was carried out for 2 hours using a current density of 12.5 mA/cm$^2$. The film thickness was 60 μm. The coating contained 1% by weight of copper.

Example 10

A circular steel electrode having a diameter of 20 mm was introduced into a sputtering unit. A circular mosiac target (diameter 150 mm), consisting of lead with copper chips (diameter 2 mm) placed on top, was inserted parallel to the steel substrate at a distance of 60 mm. The area covered in percent is shown in Table 1. The unit was evacuated with a 2-stage pump system to $10^6$ mbar.

The substrate was heated to 200° C. Thereafter, argon was introduced to a pressure of $9\times10^{-3}$ mbar. By applying an RF voltage with a power of 500 W to the substrate holder, the substrate was subjected to a sputter etching treatment for the duration of 1 minute. After the end of said treatment, the Ar pressure was brought to $5\times10^{-3}$ mbar. By applying a DC voltage to the target (power 1000 W) and an RF voltage to the substrate holder (power 200 W), a sputter plasma was ignited and a 10 μm thick (Pb-Cu) film was deposited on the stainless steel substrate. The Cu content of the electrodes thus produced is shown in Table 1.

TABLE 1

| | Area covered by the Cu chips [%] | Cu content of the electrode coating [% by weight] |
|---|---|---|
| a | 0 | 0 |
| b | 0.43 | 0.3 |
| c | 0.86 | 0.8 |
| d | 1.7 | 1.2 |
| e | 3.4 | 2.4 |
| f | 4.2 | 3.0 |
| g | 18 | 13.0 |

Example 11

Preparation of Adipodinitrile using a Cathode Consisting Completely of Lead (Comparison)

| | |
|---|---|
| Apparatus: | Undivided electrolysis cell |
| Anode: | Steel |
| Cathode: | Consisting completely of lead |
| Electrode area: | 3.14 $cm^2$ in each case |
| Electrode spacing: | 2 mm |
| Flow rate: | 1.1 m/sec |
| Current density: | 20 $A/dm^2$ |
| Temperature: | 55° C. |

The electrolyte solution was pumped through the electrolysis cell. From there, it entered a separation vessel, where the adipodinitrile formed separated off as an organic phase. Thereafter, the aqueous electrolyte was recycled to the electrolysis cell.

The aqueous phase consisted of:

7% by weight of disodium hydrogen phosphate,

2% by weight of sodium diborate,

2% by weight of acrylonitrile, 0.4% by weight of ethylenediaminetetraacetic acid, 0.1% by weight of triethanolamine and 10.5 mmol/kg of hexamethylenebis(dibutylethylammonium) phosphate (conductive salt).

The pH was brought to 8.5 with phosphoric acid.

The organic phase consisted of:

30% by volume of acrylonitrile and 70% by volume of suberodinitrile. The suberodinitrile permitted an exact determination of the adipodinitrile formed.

Before the beginning of the reaction, the two phases were equilibrated by circulation, so that acrylonitrile was dissolved in the aqueous phase (about 2% by weight). The remaining components were distributed according to their partition equilibria between the two phases. In particular, some of the conductive salt and about 4% by weight of water dissolved in the organic phase, so that the acrylonitrile concentration in the organic phase was about 26% by volume.

During the electrolysis, acrylonitrile was metered in so that its concentration in the organic phase was from 23 to 26% by volume. Further EDTA, TEOA and conductive salt were metered into the aqueous phase.

The electrolysis was operated continuously for 90 hours. After this time, the corrosion rate of the cathode consisting completely of lead was 0.35 mm/year (0.2 mg/Ah). The selectivity for adipodinitrile was 90.3%.

Example 12

The procedure was similar to that of Example 11, except that an electrochemically deposited lead film (0.05 mm) on steel was used (production according to Example 1).

The electrolysis was operated continuously for 90 hours. After this time, the corrosion rate of the lead coating was 0.25 mm/year (0.14 mg/Ah), and the selectivity for adipodinitrile was 90.4%.

Example 13

The experiment of Example 12 was repeated, except that a cathode which had a 100 μm thick lead coating was used (production according to Example 9). The electrolysis was operated continuously for 103 hours. The corrosion rate was 0.19 mm/year (0.11 mg/Ah).

Examples 12 and 13 show that less corrosion occurs with the novel cathodes.

Example 14 (Comparative Experiment)

| | |
|---|---|
| Apparatus: | Undivided electrolysis cell |
| Anode: | Carbon steel |
| Cathode: | Consisting completely of lead |
| Electrode area: | 1.9 cm × 75 cm each |
| Electrode spacing: | 1.3 mm |
| Flow rate: | 1.15 m/sec |
| Current density: | 21 $A/dm^2$ |
| Temperature: | 55° C. |

The electrolyte solution was pumped through the electrolysis cell, from where it was then passed into a separation vessel. There, the gas formed during the reaction was separated off. The electrolyte solution was then passed into a mixing unit, in which acrylonitrile and electrolyte additives were introduced. The electrolyte solution was then passed through a heat exchanger, where it was heated to 55° C. Thereafter, the electrolyte solution heated in this manner was pumped back into the electrolysis cell.

The electrolyte solution (2.5 l) had the following composition:

7% by weight of disodium hydrogen phosphate,

2% by weight of orthoboric acid, 0.4% by weight of EDTA, 0.1% by weight of TEOA and 10 mmol/kg of hexamethylenebis(dibutylethylammonium) phosphate.

The pH of the electrolyte solution was brought to 8.5 with phosphoric acid.

During the electrolysis, acrylonitrile was metered in so that its concentration in the organic phase was from 23 to 26% by volume.

In the abovementioned mixing unit, some of the electrolyte solution, containing an organic phase, was continuously separated off and transferred to a decanter, where the organic phase was separated off from the electrolyte solution and was collected, while the electrolyte solution was recycled to the mixing unit.

The selectivity based on adipodinitrile was determined from the combined organic phases. The corrosion rate was determined from the bleed stream of the electrolyte solution taken off from the mixing unit.

After three days, a corrosion rate for lead of 0.25 mm/year (0.15 mg/Ah) was determined. After a further three days, it increased to 2 mm/year (1.2 mg/Ah). Thereafter, the experiment was terminated. The adipodinitrile selectivity decreased from an initial value of 90.5% to a final value of 89.5%.

Example 15

The experiment of Example 14 was repeated, except that a cathode produced according to Example 9(*a*) was used. In addition, the electrohydrodimerization was operated for 200 hours. The corrosion rate was 0.15 mm/year (0.09 mg/Ah), and the adipodinitrile selectivity was 90.7%.

Example 16

The experiment of Example 15 was repeated, except that a cathode produced according to Example 9(*b*) was used. In addition, the electrohydrodimerization was operated for 240 hours. The corrosion rate was 0.16 mm/year (0.10 mg/Ah), and the adipodinitrile selectivity was 90.5%.

Example 17

The experiment of Example 15 was repeated, except that the electrolyte solution (2.5 l) had the following composition:

10% by weight of disodium hydrogen phosphate,
3% by weight of orthoboric acid and
10 mmol/kg of hexamethylenebis(dibutylethylammonium) phosphate.

The electrohydrodimerization was operated for 700 hours. The corrosion rate was 0.15 mm/year (0.09 mg/Ah), and the adipodinitrile selectivity was 90.4%.

Example 18 (Comparative Experiment)

As for Example 11, except that 80 mmol/kg of tributylethylanunonium phosphate were added as the conductive salt.

The electrolysis was operated continuously for 90 hours. After this time, the corrosion rate of the cathode consisting completely of lead was 0.9 mm/year (0.5 mg/Ah), and the selectivity for adipodinitrile was 89.4%.

Example 19

As for Example 12, except that 80 mmol/kg of tributylethylammonium phosphate were added as the conductive salt.

The electrolysis was operated continuously for 90 hours. After this time, the corrosion rate of the cathode consisting completely of lead was 0.21 mm/year (0.12 mg/Ah), and the selectivity for adipodinitrile was 90.5%.

Example 20

As for Example 11, but with the use of an alloy cathode containing 1.8% by weight of copper (production according to Example 2).

The electrolysis was operated continuously for 200 hours. After this time, the corrosion rate was 0.05 mm/year (0.03 mg/Ah), and the selectivity was 90.9%.

Example 21

As for Example 11, but with the use of an alloy cathode containing 0.8% by weight of copper (production according to Example 3).

The electrolysis was operated continuously for 209 hours. After this time, the corrosion rate of the lead/copper cathode was 0.16 mm/year (0.09 mg/Ah), and the selectivity was 91.4%.

Example 22

As for Example 11, but with the use of an alloy cathode containing 1.3% by weight of copper (production according to Example 4).

The electrolysis was operated continuously for 96 hours. After this time, the corrosion rate of the lead/copper cathode was 0.07 mm/year (0.04 mg/Ah), and the selectivity was 90.4%.

Example 23 (Comparative Example)

As for Example 11, but with the use of an alloy cathode containing 3.7% by weight of copper (production according to Example 5).

The electrolysis was operated continuously for 90 hours. After this time, the corrosion rate of the lead/copper cathode was 0.05 mm/year (0.03 mg/Ah), and the selectivity was 88.8%.

Example 24

As for Example 11, but with the use of a ternary alloy-cathode containing 2.2% by weight of copper and 1.3% by weight of bismuth (production according to Example 6).

The electrolysis was operated continuously for 96 hours. After this time, the corrosion rate of the lead/copper cathode was 0.08 mm/year (0.045 mg/Ah), and the selectivity was 90.0%.

Example 25

As for Example 11, but with the use of a ternary alloy cathode containing 1.3% by weight of copper and 0.5% by weight of tellurium (production according to Example 7).

The electrolysis was operated continuously for 96 hours. After this time, the corrosion rate of the lead/copper cathode was 0.09 mm/year (0.05 mg/Ah), and the selectivity was 90.9%.

Example 26

As for Example 11, but with the use of a ternary alloy cathode containing 1.3% by weight of copper and 0.1% by weight of selenium (production according to Example 8).

The electrolysis was operated continuously for 96 hours. After this time, the corrosion rate of the lead/copper cathode was 0.05 mm/year (0.03 mg/Ah), and the selectivity was 90.9%.

Example 27

| | |
|---|---|
| Apparatus: | Undivided electrolysis cell |
| Anode: | Steel |
| Cathode: | Electrochemically deposited lead/copper alloy film on steel, containing 0.8% by weight of copper (0.05 mm) (production according to Example 28) |
| Electrode area: | 80 cm × 2 cm in each case |
| Electrode spacing: | 1.3 mm |
| Flow rate: | 1.1 m/sec |
| Current density: | 21.8 A/dm$^2$ |
| Temperature: | 55° C. |

The aqueous phase was pumped through the electrolysis cell. The adipodinitrile formed separated off as an organic phase in a separation vessel. The aqueous electrolyte was then recycled to the electrolysis cell.

The aqueous phase consisted of:
88.5% by weight of water,
7% by weight of disodium hydrogen phosphate,
2% by weight of sodium diborate,
2% by weight of acrylonitrile,
0.4% by weight of ethylenediaminetetraacetic acid
0.1% by weight of triethanolamine and
10.5 mmol/kg of hexamethylenebis(dibutylethylammonium) phosphate, and had a pH of 8.5.

The organic phase consisted of: 30% by volume of acrylonitrile and 70% by volume of adipodinitrile.

Before the beginning of the reaction, the two phases were equilibrated by circulation, so that acrylonitrile was dissolved in the aqueous phase (about 2% by weight). The remaining components were distributed according to their partition equilibria between the two phases. In particular, some of the conductive salt and about 4% by weight of water dissolved in the organic phase, so that the acrylonitrile concentration in the organic phase was about 24% by volume.

During the electrolysis, acrylonitrile was metered in continuously so that its concentration in the organic phase remained constant. Aqueous phase was also continuously replaced. Bleed streams were taken simultaneously from both phases.

After 650 hours, the corrosion rate of the alloy electrode was 0.05 mm/year (0.03 mg/Ah), and the selectivity for adipodinitrile was 91.4%.

Example 28

Production of an Alloy Cathode by Electrochemical Deposition in a Coating Cell Divided by an Anion Exchange Membrane The procedure was as in Example 9(*c*), except that the catholyte and the anolyte were separated by an anion exchange membrane (Aciplex® ACH-45T). This made it possible to suppress deposition of copper on the anode during the coating.

The bath had the following composition:

| | |
|---|---|
| Catholyte | |
| Free methanesulfonic acid | 48 g/l |
| Lead methanesulfonate | 64 g/l |
| Copper methanesulfonate | 5 g/l |
| Lutensol ® AP 10 | 10 g/l |
| Anolyte | |
| Free methanesulfonic acid | 42 g/l |
| Lead methanesulfonate | 95 g/l |

Electroplating was carried out for 2 hours using a current density of 12.5 mA/cm$^2$. The film thickness was 60 μm. The alloy contained 0.8% by weight of copper.

Example 29

As for Example 11, but with the use of a cathode comprising a lead layer applied by sputtering (production according to Example 10a).

The electrolysis was operated continuously for 132 hours. After this time, the corrosion rate of the lead coating was 0.14 mm/year (0.08 mg/Ah), and the selectivity for adipodinitrile was 90.6%.

Example 30

As for Example 11, but with the use of a sputtered lead/copper cathode containing 2.4% by weight of copper (production according to Example 10e).

The electrolysis was operated continuously for 90 hours. After this time, the corrosion rate of the lead/copper cathode was 0.08 mm/year (0.045 mg/Ah), and the selectivity for adipodinitrile was 90.3%.

We claim:

1. An electrode consisting of an electrically conductive core of iron and a covering of an electrically conductive coating of lead.

2. An electrode according to claim 1, wherein the coating of lead has a thickness of from 1 to 500 μm.

3. An electrode according to claim 1, wherein the coating of lead has a thickness of from 20 to 200 μm.

4. An electrode consisting of an electrically conductive core of iron and a covering of an electrically conductive coating composed of lead and other metals in amounts of up to 3.5% by weight selected from the group consisting of copper, silver, selenium, tellurium, bismuth and antimony, where that said coating is not composed of lead, silver and bismuth.

5. An electrode according to claim 4, wherein the coating is composed of lead and copper.

6. An electrode according to claim 4, wherein the coating is composed of lead, copper and bismuth.

7. An electrode according to claim 4, wherein the coating is SOPHER et al., Ser. No. 08/255,746 composed of lead, copper and tellurium.

8. An electrode according to claim 4, wherein the coating is composed of lead, copper and selenium.

* * * * *

UNITED STATES PATENT AND TRADEMARK OFFICE

CERTIFICATE OF CORRECTION

PATENT NO.: 5,593,557

DATED: January 14, 1997

INVENTOR(S): SOPHER et al.

It is certified that error appears in the above-identified patent and that said Letters Patent is hereby corrected as shown below:

Column 14, line 56, claim 7, delete "SOPHER et al., Ser. No. 08/255,746".

Signed and Sealed this

Fourth Day of March, 1997

Bruce Lehman

*Attest:*

BRUCE LEHMAN

*Attesting Officer*

*Commissioner of Patents and Trademarks*